US011549793B2

(12) United States Patent
Krzecki

(10) Patent No.: US 11,549,793 B2
(45) Date of Patent: Jan. 10, 2023

(54) BLANK FIRING DEVICE

(71) Applicant: Sleep Environment Innovations LLC, Milwaukee, WI (US)

(72) Inventor: Alex Krzecki, Shorewood, WI (US)

(73) Assignee: Sleep Environment Innovations LLC, Milwaukee, WI (US)

( * ) Notice: Subject to any disclaimer, the term of this patent is extended or adjusted under 35 U.S.C. 154(b) by 0 days.

(21) Appl. No.: 17/400,587

(22) Filed: Aug. 12, 2021

(65) Prior Publication Data

US 2022/0049941 A1 Feb. 17, 2022

Related U.S. Application Data

(60) Provisional application No. 63/064,778, filed on Aug. 12, 2020.

(51) Int. Cl.

| | |
|---|---|
| ***F42C 1/06*** | (2006.01) |
| ***F42C 14/02*** | (2006.01) |
| ***F42B 27/00*** | (2006.01) |
| ***F42B 12/42*** | (2006.01) |

(52) U.S. Cl.
CPC ..... *F42B 27/00* (2013.01); *F42B 12/42* (2013.01)

(58) Field of Classification Search
CPC ..... F42C 1/06
See application file for complete search history.

(56) References Cited

U.S. PATENT DOCUMENTS 1,316,367 A * 9/1919 Knight ..... F42C 14/02 102/260
1,481,635 A * 1/1924 Councilman ..... F42C 1/06 102/260
1,709,798 A * 4/1929 Lebensart ..... F42C 14/02 102/260

(Continued)

FOREIGN PATENT DOCUMENTS

EP 3059544 A1 8/2016
FR 2699662 A1 6/1994

(Continued)

OTHER PUBLICATIONS

Search Report for Application No. GB2111630.6 dated May 26, 2022, 2 pages.

(Continued)

*Primary Examiner* — Derrick R Morgan
(74) *Attorney, Agent, or Firm* — Boyle Fredrickson, S.C.

(57) ABSTRACT

A diversionary device trigger mechanism is provided that can be repeatedly used, and which allows a primer or blank to be discharged in two different ways. The device includes a main body with a number of other components secured to the main body about an upper chamber and a lower chamber. A firing pin, a ball bearing, an anvil, a top retaining cap, and a plunger are secured about the upper chamber. A blank carrier, a primer or blank, and a carrier receiver are secured about the lower chamber. In the first way, the ball bearing can be displaced relative to the main body, such as by throwing the device towards a surface. In the second way, the plunger can be pushed down relative to the main body. If either of these occur, the firing pin to be moved downwardly to pierce and set off the primer or blank.

19 Claims, 4 Drawing Sheets

(56) References Cited

U.S. PATENT DOCUMENTS 1,770,577 A * 7/1930 Lebensart ..... F42C 1/06 102/488
2,358,647 A * 9/1944 Kula ..... F42C 14/02 102/260
2,420,662 A * 5/1947 Hale ..... F42C 1/06 102/258
2,469,587 A * 5/1949 Wittel ..... F42C 14/02 102/260
2,701,527 A * 2/1955 Granath ..... F42C 15/24 102/242
3,049,999 A * 8/1962 Sunden ..... F42C 9/142 102/487
3,112,703 A * 12/1963 Urdapilleta ..... F42C 15/23 102/270
3,410,215 A * 11/1968 Apotheloz ..... F42C 15/24 102/273
3,877,379 A * 4/1975 Losfeld ..... F42C 1/06 102/260
4,160,414 A * 7/1979 Stockman ..... F42B 30/04 102/483
4,715,281 A * 12/1987 Dinger ..... F42C 1/06 102/273
7,332,296 B2 1/2008 Ellis
11,054,234 B2 * 7/2021 Thomas ..... F42C 15/44
2007/0283833 A1 * 12/2007 George Ellis ..... F42B 27/08 102/498
2018/0135954 A1 * 5/2018 Thomas ..... F42C 15/44

FOREIGN PATENT DOCUMENTS

GB 102390 A 12/1916
GB 2280249 A 1/1995

OTHER PUBLICATIONS

ALS, TRMR-LE User Guide, Apr. 22, 2020, https://www.lesslethal.com/component/edocman/?task=document.viewdoc&id=232&Itemid=.
ALS, TRMR-LR Tactical Training Device, https://www.lesslethal.com/product-specifications?task=document.viewdoc&id=233.

* cited by examiner

BLANK FIRING DEVICE

CROSS-REFERENCE TO RELATED APPLICATION

The present invention claims priority on U.S. Provisional Patent Application Ser. No. 63/064,778 filed on Aug. 12, 2020 and entitled Blank Firing Device, the entirety of which is hereby incorporated herein by reference.

FIELD OF INVENTION

The present invention relates to a diversionary device. More specifically, the present invention relates to the firing or trigger mechanism of a reloadable diversionary device.

DISCUSSION OF RELATED ART

Diversionary devices, also known as light-sound devices, flashbangs, and distraction devices, are generally used by law enforcement and military personnel or those who enjoy combat simulation sports, to physiologically and psychologically stun a person. Diversionary devices generally include a housing containing a pyrotechnic charge and a detonation mechanism and emit a loud noise, pressure, and/or flash of light to stun or otherwise divert a person. The preferred embodiment of the diversionary device in accordance with the present invention does not expel matter or cause a meaningful concussive blast or flash which may cause physical injuries to the person or other people in the surrounding vicinity. However, one of skill in the art could modify the preferred embodiment to provide for the activation of larger charges or the expulsion of matter that could cause such injuries without departing from the spirit and scope of the invention.

Diversionary devices are expensive because many of them can only be used once. Thus, it may be cost prohibitive to use diversionary devices for training or entertainment purposes. In efforts to make diversionary devices more economical, reloadable diversionary devices have been created. Those devices, however, have components which eventually break and further do not fire consistently.

What is therefore needed is a diversionary device that overcomes one or more of these deficiencies. What is further needed is a diversionary device that can be durably constructed in order for the device to be repeatedly used. What is further needed is a diversionary device that continues to operate with consistent firing quality after multiple uses. What is further needed is a diversionary device is thrown that can be activated in multiple ways regardless of how the device lands.

SUMMARY OF INVENTION

In accordance with an aspect of the present invention, a blank firing device is provided having two different trigger mechanisms. The device includes a main body, a blank carrier cartridge, a firing pin, a spring, a bearing, and a plunger. The main body has a first end, a second end and a sidewall. The blank carrier cartridge contains a primer or blank, and is secured to the first end of the main body. The firing pin, spring, and bearing are all located within the main body, which the spring located adjacent a first end of the firing pin and the bearing being adjacent a second end of the firing pin. The plunger extends from the second end of the main body. The first trigger mechanism consists of the bearing being moved towards the main body sidewall, which causes the firing pin to pierce the blank carrier cartridge to activate the primer or blank. The second trigger mechanism consists of the plunger moving towards the first end of the main body, which causes the firing pin to pierce the blank carrier cartridge to activate the primer or blank.

According to another aspect of the present invention, the main body includes an upper chamber, a lower chamber, a lip separating the upper chamber from the lower chamber, and a channel extending through the lip to connect the upper chamber to lower chamber. Additionally, the firing pin has a cone section configured to receive a portion of the bearing and a stem extending downwardly from the cone section to a pointed end. The spring may be wrapped around the stem, which causes the spring to bias the firing pin away from the blank carrier cartridge. The stem is partially within the channel. When the first trigger mechanism or second trigger mechanism occurs, the firing pin overcomes the spring force causing the stem to extend through channel such that the pointed end pierces the primer or blank.

According to yet another aspect of the present invention, the plunger moves the bearing and the firing pin towards the blank carrier cartridge in the second trigger mechanism. Additionally, the device may further include a top retaining cap with a bore extending therethrough, and an anvil having an anvil shaft extending therefrom. The plunger may also include a plunger shaft and a plunger bore formed in the plunger shaft. When assembled, the plunger shaft extends through the top retaining cap bore and the anvil shaft extends through the plunger bore. The top retaining cap is then secured to the second end of the main body. The anvil is located adjacent the bearing, such that when the plunger is moved towards the blank carrier cartridge, the anvil drives the bearing and firing pin towards the blank carrier cartridge.

According to another aspect of the present invention, a carrier received that is configured to receive the blank carrier cartridge is secured to the first end of the main body. The blank carrier cartridge has a first end configured to receive a first blank or charge and a second end configured to receive a second blank or charge. This allows the blank carrier cartridge to be inverted relative to the main body depending on the blank or change that is desired.

According to another aspect of the present invention, a method of using a diversionary device is provided. The method includes the steps of inserting a blank or charge into a blank carrier cartridge, inserting the blank carrier cartridge into a main body, moving a bearing to overcome a spring force to displace a firing pin towards the blank carrier cartridge in a first trigger mechanism, moving a plunger to overcome the spring force to displace the firing pin towards the blank carrier cartridge in a second trigger mechanism, and piercing the blank carrier cartridge by the firing pin to activate the blank or charge. To achieve the first trigger mechanism, the main body is propelled towards a surface such that the bearing which is a ball bearing towards a sidewall of the main body when the main body contacts the surface, which causes the firing pin to move towards the blank carrier cartridge. More specifically, the ball bearing contacts a cone section of the firing pin, which causes a stem that extends to a pointed end of the firing pin when the ball hearing moves the cone section. In the second trigger mechanism, an anvil attached to the plunger contacts the bearing, which causes the bearing and firing pin to move towards the blank carrier cartridge. Once the blank or charge has been activated it can be removed, after which a second blank or charge can be inserted, after which the blank carrier cartridge is reinserted into the main body. Additionally, differently sized blanks or cartridges may be inserted into opposite ends of the blank carrier cartridge, allowing for different blanks or charges to be used depending on whether the first end or the second end is inserted first into the main body.

These and other aspects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof. It is hereby disclosed that the invention include all such modifications.

BRIEF DESCRIPTION OF THE FIGURES

A clear conception of the advantages and features constituting the present invention will become more readily apparent by referring to the exemplary, and therefore non-limiting, embodiments illustrated in the drawings accompanying and forming a part of this specification, wherein like reference numerals designate the same elements in the several views.

In the drawings.

DETAILED DESCRIPTION

Figure 1:
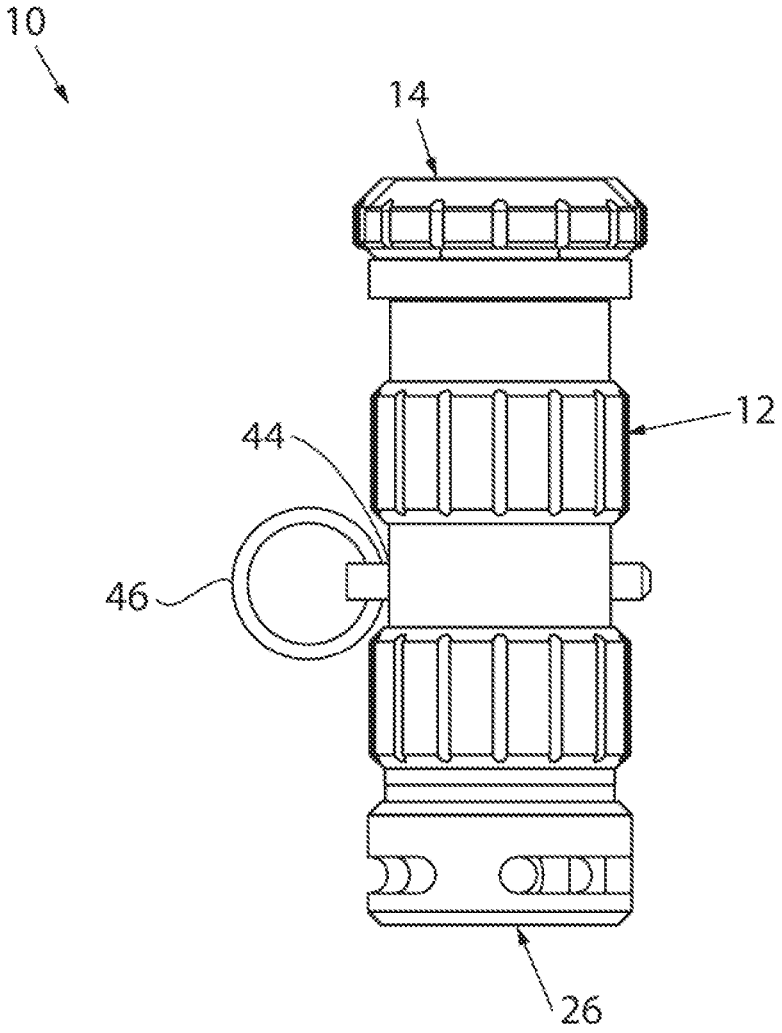
FIG. 1 is a side elevation view of one embodiment of the blank firing device of the present invention.
Figure 2:
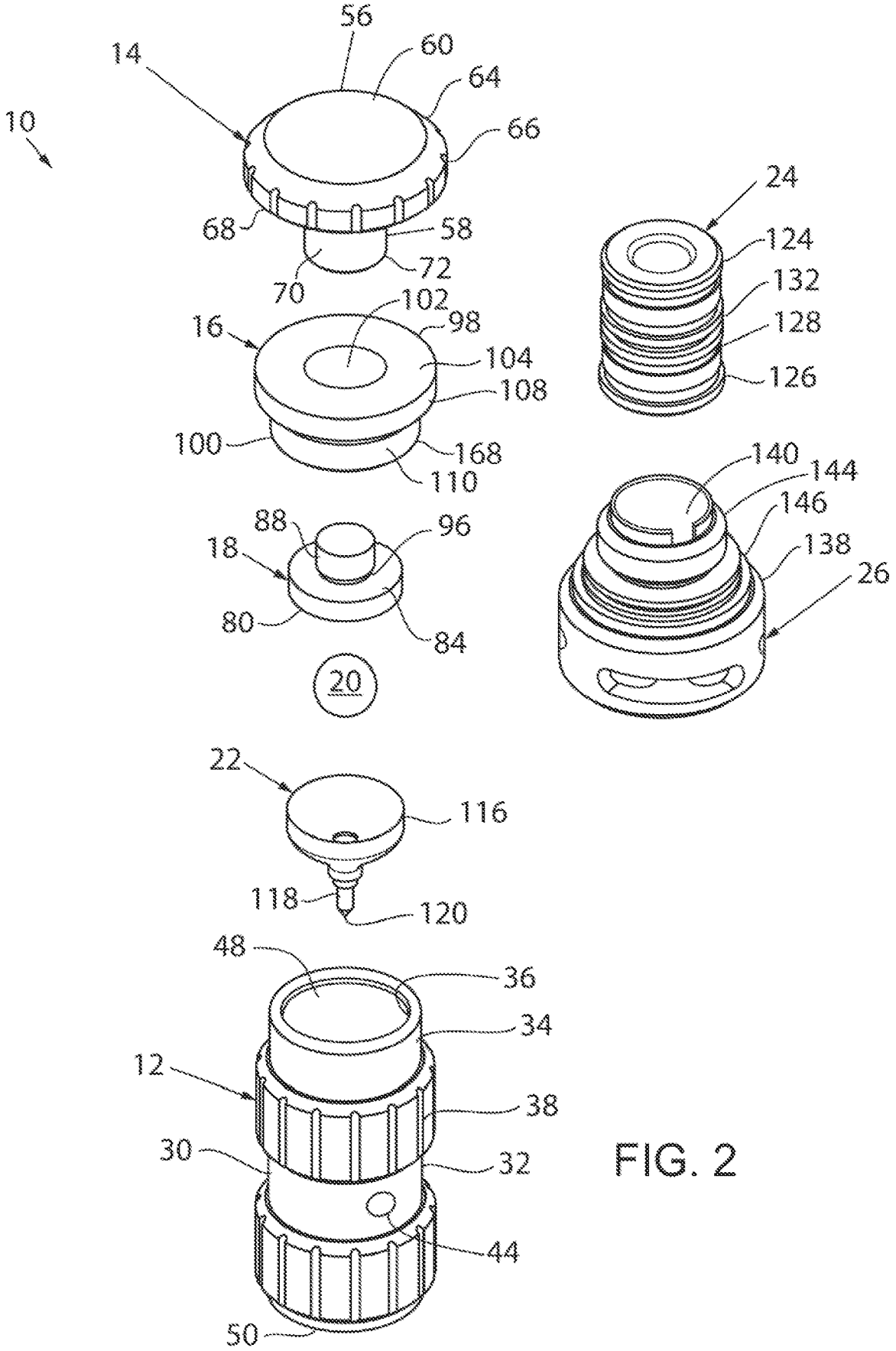
FIG. 2 is an exploded isometric perspective view of the embodiment of a blank firing device shown in FIG. 1.

The present invention and the various features and advantageous details thereof are explained more fully with reference to the non-limiting embodiments described in detail in the following description.

As shown in the figures, a blank firing device 10, includes a number of components that can be nested relative to one another, including a main body 12, a plunger 14, a top retaining cap 16, an anvil IS, a bearing 20, a firing pin 22, a blank carrier 24, and a carrier receiver 26. Each of these components will be further described below. In use, the blank firing device 10 can be activated by hand or otherwise thrown or projected. When the blank firing device 10 makes contact with a surface, such as the ground, the firing pin 22 contacts a primer or blank 28 to generate a flash and a sound. The blank firing device 10 is configured to be activated regardless of how the device 10 makes contact with the surface.

The main body 12 includes a generally cylindrical housing 30 with a sidewall 32 having an exterior surface 34 and an interior surface 36. The exterior surface 34 may have various textured surfaces 38 to facilitate the grasping of the main body 12. The interior surface 36 includes a threading 40 formed adjacent to the top of the main body 12 and another threading 42 formed adjacent to the bottom of the main body 12, which engage with other components as will further be described below. Additionally, an aperture 44 may be formed in the sidewall 32 that is configured to receive a safety pin 46. As long as the safety pin 46 is inserted into the sidewall 32, the firing pin 22 will be prevented from engaging with a charge as will further be described below.

Figure 4:
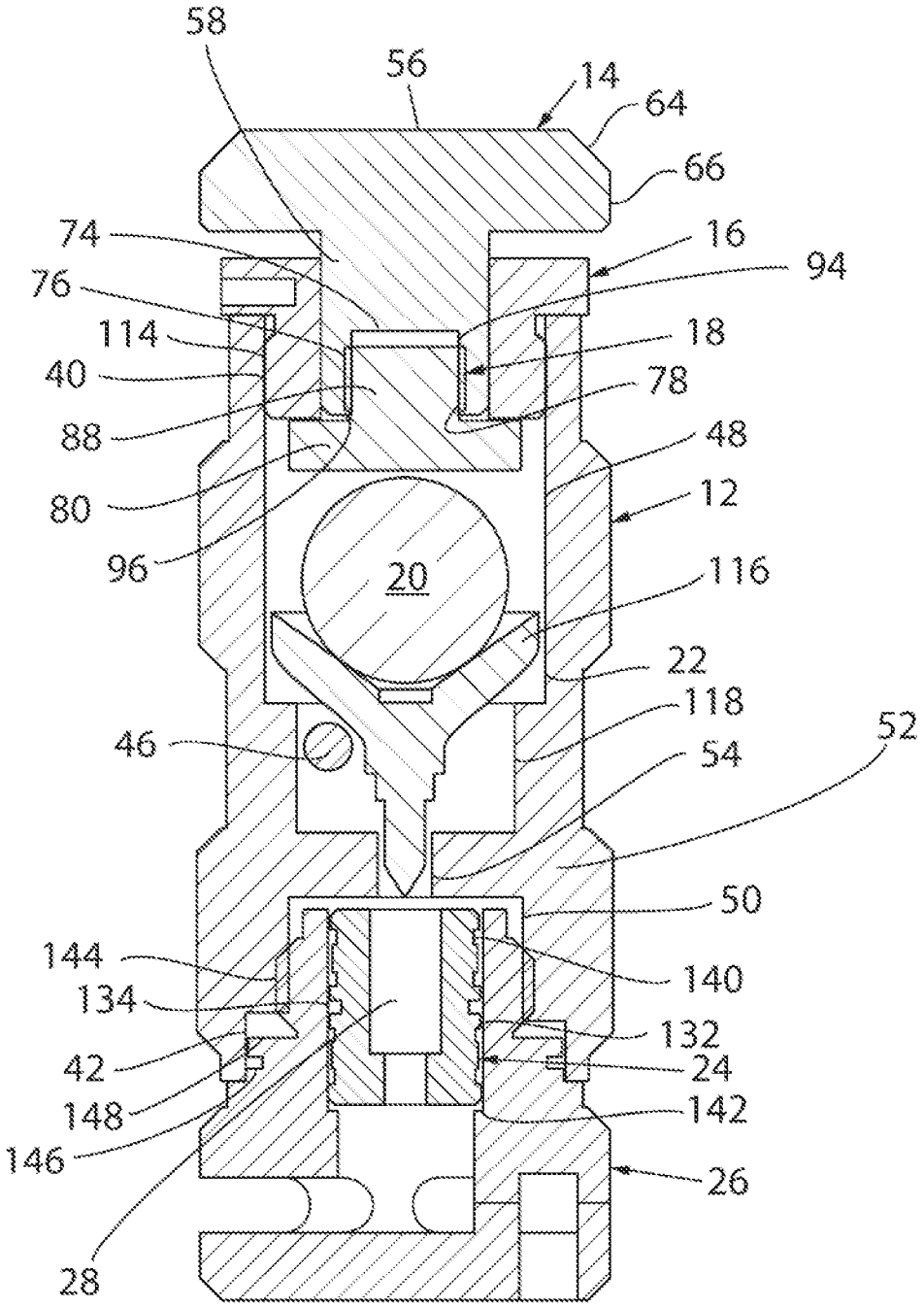
FIG. 4 is a cross sectional view of the embodiment of the blank firing device of FIGS. 1-3.

The main body 12 has an upper chamber 48 and a lower chamber 50 separated by a lip 52 with a channel 54 formed therein. As shown in FIG. 4, The upper chamber 48 houses the main elements of the firing pin 22 which extends partially through the channel 54, as well as the bearing 20, the anvil 18, and portions of the top retaining cap 16 and the plunger 14. The lower chamber 50 houses the blank carrier 24 and the primer or blank 28 when it is deployed as well as at least a portion of the carrier receiver 26.

A number of the components associated with the blank firing device 10 are substantially T-shaped when viewed from the side, and like the main body 12 are generally cylindrical in shape. For the purposes of this description, these components are defined as having a base with a shaft extending therefrom, where the base has a larger radius than the shaft meaning that the base is the top of the "T". Each base has an upper surface and a lower surface, whereas the shaft only has one of an upper surface or a lower surface depending on whether it is located above or beneath the base. Additionally, each of these bases and shafts have at least one sidewall as will further be described below, some of which have threads, rings, or other indentations formed therein. These components will be described as having a T-shape or an inverted T-shape based on their appearance in the figures, although the blank firing device 10 would understandably operate regardless of its orientation.

Figure 3:
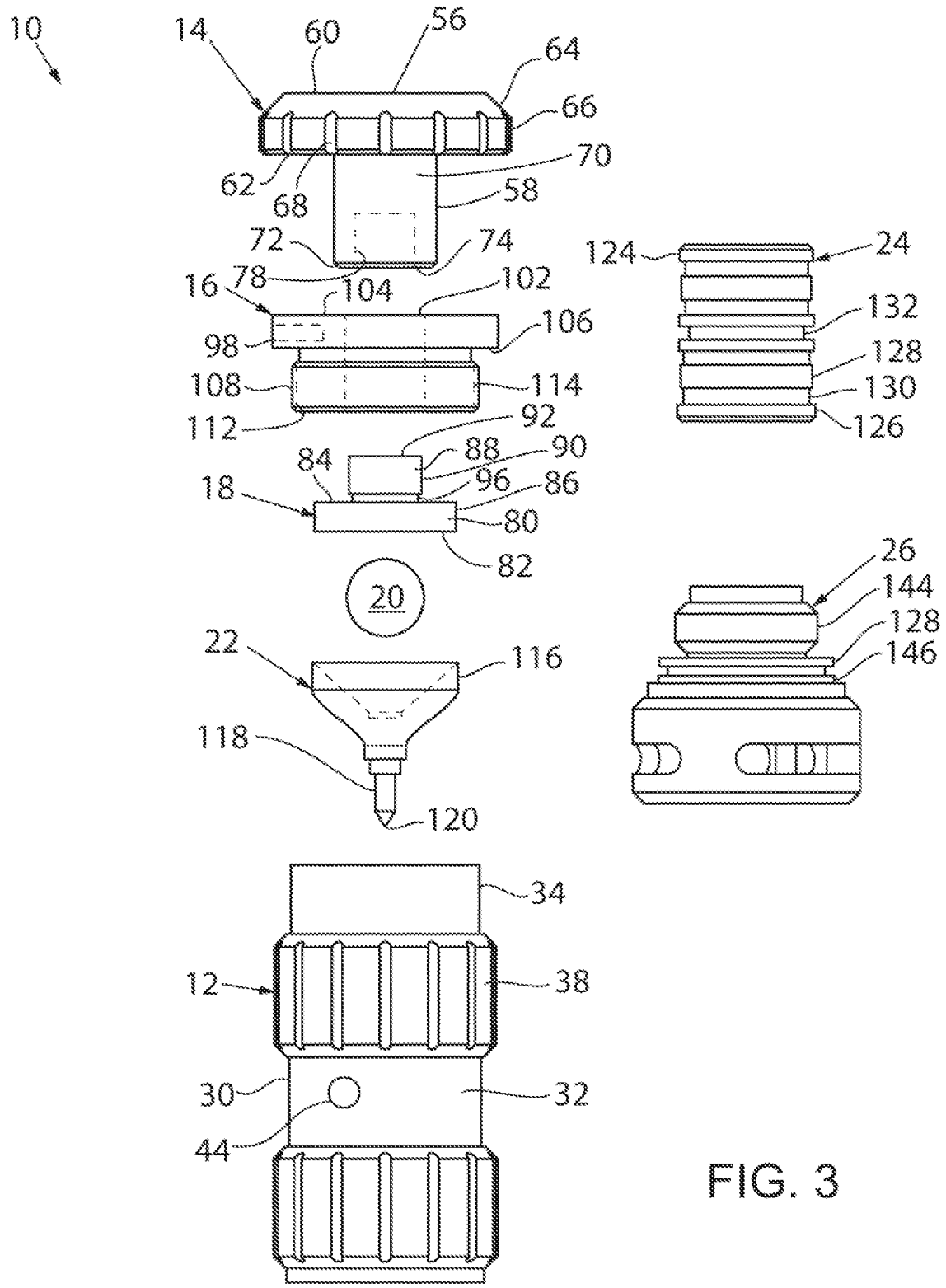
FIG. 3 is an exploded side elevation view of the embodiment of the blank firing device of FIGS. 1 and 2.

The first of these substantially T-shaped components is the plunger 14. Looking to FIG. 3, the plunger 14 has a plunger base 56 that serves as an upper, external plunger section and a plunger shaft 58 that is a lower, internal plunger section that extends downwardly from the base 56. In one embodiment of the present invention, the base 56 has a flat upper surface 60 and a flat lower surface 62. In the illustrated embodiment, the plunger base 56 also includes an angled upper sidewall portion 64 and a lower vertical sidewall 66 located and positioned between the plunger upper surface 60 and the plunger lower surface 62. The vertical sidewall 66 may further include a series of grooves 68 or other textured pattern that provide increased friction to reduced slippage when the plunger 14 is twisted relative to the main body 12. The plunger shaft 58 extends downwardly from the lower surface 62 of the base 56, and features a sidewall 70 and a lower surface 72. A central bore 74 is formed in the shaft 58, which extends upwardly from the lower surface 72. In some embodiments such as what is shown in FIG. 4, threads 76 are formed in the side of the bore 74. Additionally, in a preferred embodiment, an annular ring 78 is formed around the central bore 74 along the shaft lower surface 72. The central bore 74 is configured for receipt of and engagement with the anvil 18.

The anvil 18 is in the shape of an inverted "T" including a lower base 80 having a lower surface 82, an upper surface 84, and a sidewall 86. Additionally, the anvil 18 has a shaft 88 that extends upwardly from the upper surface 84 of the base 80. The shaft 88 also has a sidewall 90 and an upper surface 92. The shaft 88 is configured to fit within the central bore 74 of the plunger 14. The sidewall of the shaft 88 may include threads 94. Additionally, in the illustrated embodiment, an annular groove 96 is formed in the shaft 88 adjacent to the upper surface 84 of the base 80. The annular ring 78 is configured to fit within and cooperate with the annular groove 96 of the plunger 14 to maintain the anvil 18 in position relative to the plunger 14. Preferably, the lower surface 72 of plunger shaft 58 interacts with the upper surface 84 of the anvil base 80 such that when the plunger 14 translates downwardly, it imparts that same motion to the anvil 18. Alternatively, the translation of movement (in an upward or downward direction) from the plunger 14 to the anvil 18 may be achieved via cooperation of the annular groove 96 and the annular ring 78 or other cooperative engagement between the plunger 14 and the anvil 18.

The plunger 14 and anvil 18 are maintained within the main body 12 through interaction with the top retaining cap 16, which will now be described. The top retaining cap 16 is also substantially T-shaped, with an upper base 98, a shaft 100 extending downwardly therefrom, and a central bore 102 that extends through both the base 98 and the shaft 100. The base 98 includes an upper surface 104, a lower surface 106, and a sidewall 108. The shaft 100 includes a sidewall 110 and a lower surface 112. As seen best in FIG. 4, the shaft sidewall 110 includes threads 114 that are configured to cooperate with threads 40 formed in the inner surface of the main body 12 adjacent the top of the upper chamber 48. Additionally, the shaft 58 of the plunger 14 is configured to extend through and be maintained within the central bore 102 of the top retaining cap 16, where the lower surface 72 of the plunger 14 and the lower surface 106 of the top retaining cap 16 are substantially flush when the shaft 58 of the plunger 14 is inserted into the top retaining cap 16. Once the plunger 14 is nested within the top retaining cap 16, the shaft 88 of the anvil 18 is insertable into the central bore 74 of the plunger 14. The shaft 88 may be secured within the central bore 74 by the threads 76, 94, although these components could similarly be secured to one another using a pressure, snap, or other fit. When this occurs, the plunger 14, anvil 18, and top retaining cap 16 are secured together.

The plunger 14, anvil 18, and top retaining cap 16 assembly can be secured to the main body 12 using the threads 40, 114. As shown, the radius of the top retaining cap 16 base 98 is such that when installed onto the main body 12, the sidewall 108 of the top retaining cap 16 base 98 is substantially flush with the exterior surface 34 of the sidewall 32 of the main body 12. Because the anvil base 80 abuts the lower surface 112 of the top retaining cap 16 and because the anvil 18 is secured to the plunger 14, the top retaining cap 16 precludes the plunger 14 from being pulled out of the blank firing device 10. Additionally, as best seen in FIGS. 1 and 4, the lower surface 62 of the base 56 of the plunger 14 is vertically offset from the upper surface 104 of the base 98 of the top retaining cap 16. This allows the plunger 14, and the anvil 18 to move vertically relative to the top retaining cap 16 and the main body 12.

In the preferred illustrated embodiment, the firing pin 22 is formed in the shape of a cylindrical "Y" with an upper cone 116, a stem 118 extending downwardly from the upper cone 116, and a terminal end point 120 that acts to contact and/or pierce a primer or blank 28 during operation. The firing pin 22 is located at the bottom of the upper chamber 47 of the main body 12. The upper cone 116 preferably is at an angle of between 27.5° and 47.5°, and more preferably about 37.5° above the horizontal. The stem 118 fits within and is contained by the channel 54 that extends between the upper and lower chambers 48, 50 of the main body 12 as best seen in FIG. 4. A spring 122 surrounds the stem 118 and is constrained between the upper cone 116 of the firing pin 22 and the lip 52 of the upper chamber 48 of the main body 12. The spring 122 it an upward spring bias on the firing pin 22 so that it does not trigger inadvertently. The firing pin 22 is prevented from lateral movement by the sidewalls of the upper chamber 48 of the main body 12.

As seen in FIG. 4, the bearing 20 is maintained within the upper cone 116 of the firing pin 22. The illustrated bearing 20 is a ball bearing that is substantially circular in shape, although other shaped bearings could be used, such as an oval-shaped bearing. The ball bearing 20 of the illustrated embodiment is also in contact with or closely proximate the anvil 18 such that downward movement of the plunger 14 will result in the ball bearing 20 imparting downward force on the firing pin 22. Similarly, when the hall bearing 20 moves laterally within the main body 12, it contacts the sloped sides of the upper cone 116 of the firing pin 22 thereby imparting a downward force on the firing pin 22. An appropriate configuration of the spring 122 provides adequate spring bias to prevent inadvertent activation of the firing pin 22 while allowing the movement of the ball bearing 20 as a result of impact of the main body 12 or movement of the plunger 14 to activate the firing pin 22 on demand. More specifically, the spring 122 provides sufficient bias to support the weight of the components located in the upper chamber 48.

The blank carrier 24 is preferably shaped and sized to hold reactive charges (e.g., 0.209 primer or 9 mm blank). In one embodiment, the blank carrier 24 has a first blank carrier end 124, a second blank carrier end 126, and a sidewall 128 extending from the first end 124 to the second end 126. The blank carrier sidewall 128 may be smooth or have a series of grooves and/or protrusions, 130 so that the blank carrier 24 is easier to hold. The blank carrier sidewall 128 further includes at least one groove 132 shaped and sized so that art O-ring 134 (shown in FIG. 4) may be placed within to assist in securing the blank firing device 10 to a carrier receiver 26.

Each end 124, 126 is adapted to hold a differently sized charge. To facilitate this, the blank carrier 24 includes a channel 136 that extends all the way through the blank carrier 24 between the two ends 124, 126. The channel 136 preferably has a larger diameter at one end (e.g., 124) and a smaller diameter at the other end (e.g., 126). See FIG. 4. In another embodiment of the present invention a channel does not extend all the way through the blank carrier 24. Instead, two channels (not shown) of differing diameters each extend inwardly from an end (124 or 126), but without achieving communication between the two channels. In either case, the blank carrier 24 is reversible, i.e., capable of being flipped 180 degrees, to present the chosen charge to the firing pin 22 for activation.

The carrier receiver 26 includes a carrier receiver sidewall 138, a central channel 140 sized and shaped to receive and hold the blank carrier 24, with a shoulder 142 formed around the central channel 140. The blank carrier 24 itself is sized and shaped such that when it is inserted into the carrier receiver channel 140 it rests against shoulder 142 of the carrier receiver 26. This places the charge within the blank carrier 24 in the proper position to be activated by the firing pin 22. In the illustrated embodiment, the carrier receiver 26 has outer threads 144 that mate with and allow the carrier receiver 26 to selectively engage with threads 42 formed in the interior surface 36 of the main body 12 within the lower chamber 50. The carrier receiver 26 may further include at least one carrier receiver groove 146. As shown, the carrier receiver groove 146 is located and positioned at the carrier receiver sidewall 138 and is shaped and sized so that an O-ring 148 may be placed within to assist in forming a seal between the carrier receiver 26 and the main body 12.

In use, a primer or blank 28, for example, a 9 mm blank, may be inserted into the first blank carrier end 124 of the blank carrier 24. Additionally, another sized blank, such as a 0.209 primer may be inserted into the second blank carrier end 126. Thus, the blank carrier 24 is reversible and may be used with either a 0.209 primer or 9 mm blank. Of course, other sized blanks or primers can also be utilized and the carrier sized or omitted accordingly. For example, an alternative blank carrier (or no blank carrier) may be used to permit the deployment of larger caliber charges such as a 12-gauge blank. The blank carrier 24 is then inserted into the carrier receiver 26 so that the 0.209 primer or 9 mm blank is located at the top of the lower chamber 50, proximate to and in alignment with the terminal end point 120 of the firing pin 22. The safety pin 46 (shown in FIG. 1) may be inserted into the aperture 44 of the main body 12, thereby preventing the firing pin 22 from moving downwards to engage the primer or blank 28 located in the blank carrier 24.

After the blank carrier 24 has been loaded into the blank firing device 10, the safety pin 46 is removed from the main housing 25. Once the safety pin 46 has been removed, the blank firing device 10 is live. As discussed above, the blank firing device 10 can activate its carried primer or blank 28 in two ways. In the first manner of discharge, the blank firing device 10 is made to impact a surface such that the plunger 14 is not engaged. For instance, this may occur when the blank firing device 10 is thrown or otherwise projected away from a user. In such cases, contact of the main body 12 of the blank firing device 10 with the ground or other surface causes a sudden acceleration which displaces the ball bearing 20 within the upper chamber 48 towards the sidewall 32. The inertia caused by the contact and the mass of the ball bearing 20 overcomes the spring bias of the spring 122. As the ball bearing 20 moves laterally towards the sidewall 32, it causes the cone 116 and in turn the entire firing pin 22 to move downwards so that the firing pin terminal end point 120 pierces the primer or blank 28 and sets it off.

In the second manner of discharge, the plunger 14 is pressed down by contact thereby forcing the plunger 14, anvil 18, ball bearing 20, and firing pin 22 to move along a vertical axis. When enough force is applied against the plunger 14 to overcome the spring bias of the spring 122, the firing pin terminal end point 120 pierces the primer or blank 28 and sets it off. The second manner of discharge is a failsafe if the vector of acceleration from impact is in a direction that does not displace the ball bearing 20 enough to move the firing pin 22, such as where the device 10 lands on the upper surface 60 of the base 56 of the plunger 14. Alternatively, the second manner of discharge can also be used when a user wishes to set off the device 10 without throwing by simply striking the upper surface 60 of the base 56 of the plunger 14 with a hand, a wall, or another surface while still holding onto the device 10.

It should be understood that the above description, while indicating representative embodiments of the present invention, is given by way of illustration and not of limitation. Many changes and modifications may be made within the scope of the present invention without departing from the spirit thereof, and the invention includes all such modifications.

Various additions, modifications, and rearrangements are contemplated as being within the scope of the following claims, which particularly point out and distinctly claim the subject matter regarding as the invention, and it is intended that the following claims cover all such additions, modifications, and rearrangements.

I claim:

1. A blank firing device comprising:

a main body having a first end, a second end, and a side wall;

a primer or a blank contained within the main body;

a bearing;

a firing pin located within the main body and proximate the bearing comprising;

a substantially cone shaped portion configured to receive a portion of the bearing; and a stem extending downwardly from the substantially cone shaped portion;

a plunger extending through the second end of the main body;

a first trigger mechanism wherein the bearing is moved towards the sidewall causing the firing pin to activate the primer or blank when the main body contacts a surface; and a second trigger mechanism wherein the plunger is moved towards the first end causing the firing pin to activate the primer or blank when the plunger is engaged by impact;

wherein the firing pin is biased away from the primer or blank; and wherein the firing pin over comes the bias when the first trigger mechanism or the second trigger mechanism is activated.

2. The blank firing device of claim 1, wherein the main body further comprises:

an upper chamber;

a lower chamber;

a lip separating the upper chamber and the lower chamber; and a channel extending through the lip to connect the tipper chamber to the lower chamber.

3. The blank firing device of claim 2, further comprising:

a spring engaged with the stem;

wherein the spring biases the firing pin away from the blank carrier cartridge;

wherein the firing pin is held in the upper chamber; and wherein the firing pin overcomes the spring force and the stem extends through the channel into the lower chamber when the first trigger mechanism or the second trigger mechanism is activated.

4. The blank firing device of claim 1, wherein the plunger moves the bearing and the firing pin towards the blank carrier cartridge in the second trigger mechanism.

5. The blank firing device of claim 4, further comprising:

a top retaining cap having a top retaining cap bore extending therethrough; and an anvil having an anvil shaft extending therefrom;

wherein the plunger further comprises:

a plunger shaft; and a plunger bore formed in the plunger shaft;

wherein the plunger shaft extends through the top retaining cap bore;

wherein the anvil shaft extends through the plunger bore; and wherein the top retaining cap is secured to the second end of the main body.

6. The blank firing device of claim 5, wherein the anvil is adjacent to the bearing; and wherein the plunger moves anvil to contact the bearing and moves the firing pin towards the blank carrier cartridge in the second trigger mechanism.

7. The blank firing device of claim 2, further comprising a carrier receiver configured to receive the blank carrier cartridge;

wherein the blank receiver is secured to the lower chamber of the main body.

8. The blank firing device of claim 2, wherein the blank carrier cartridge further comprises:

a first end configured to receive a first blank or charge; and a second end configured to receive a second blank or charge;

wherein in a first configuration the first end is inserted into the lower chamber of the main body; and wherein in a second configuration the second end is inserted into the lower chamber of the main body.

9. A method of using a diversionary device comprising the steps of:

inserting a blank or charge into a main body;

propelling the main body towards a surface;

biasing a firing pin away from the blank or cartridge;

moving one of;

a first trigger mechanism comprising a bearing towards a sidewall of the main body where the bearing contacts a substantially cone shaped section of the firing pin to overcome a spring force to displace a firing pin towards blank or charge in a first trigger mechanism; or a second trigger mechanism displacing the firing pin towards the blank or charge;

moving a stem of the firing pin against a biasing force that extends to a pointed end of the firing pin;

and activating the blank or charge.

10. The method of claim 9, further comprising the steps of:

displacing the bearing towards a sidewall of the main body when the main body contacts the surface;

moving the stem against the biasing force when the bearing moves the cone section; and piercing the blank carrier cartridge with the pointed end.

11. The method of claim 9, further comprising the steps of:

moving an anvil attached to the plunger to contact the bearing;

moving the bearing and the firing pin towards the blank carder cartridge; and piercing the blank carrier cartridge with the pointed end.

12. The method of claim 9, further comprising the steps of:

removing the blank carrier cartridge after the blank or charge has been activated;

inserting a second blank or charge into the blank carrier cartridge; and reinserting the blank carrier cartridge into the main body.

13. A diversionary device trigger mechanism comprising:

a main body having a first end and a second end and a vertical axis extending from the first end and second end;

a first trigger mechanism comprising:

a bearing, a firing pin comprising:

a substantially cone shaped portion configured to receive a portion of the bearing, and a stem extending downwardly from the substantially cone shaped portion, wherein the bearing and firing pin are located and positioned within a main body channel;

a second trigger mechanism configured to move the firing pin along the vertical axis;

a blank or charge further located within the main body;

wherein the firing pin is biased away from the blank or charge;

wherein one of the first trigger mechanism and the second trigger mechanism overcomes the bias to force the firing pin to activate the blank or charge thereby setting off the diversionary.

14. The diversionary device trigger mechanism of claim 13, wherein the bearing is a substantially circular ball bearing.

15. The diversionary device mechanism of claim 13, wherein the bearing is substantially oval in shape.

16. The diversionary device trigger mechanism of claim 13, further comprising a spring configured to bias the firing pin away from the cartridge until the first trigger mechanism or the second trigger mechanism is triggered.

17. The diversionary device trigger mechanism of claim 16, wherein the main body further comprises:

an upper chamber;

a lower chamber;

a lip separating the upper chamber and the lower chamber; and a channel extending through the lip to connect the upper chamber to the lower chamber; and wherein the firing pin is configured to move through the channel when the first trigger mechanism or the second trigger mechanism is triggered.

18. The diversionary device trigger mechanism of claim 17, wherein the blank carrier cartridge further comprises:

a first end configured to receive a first blank or charge; and a second end configured to receive a second blank or charge;

wherein in a first configuration the first end is inserted into the lower chamber of the main body; and wherein in a second configuration the second end is inserted into the lower chamber of the main body.

19. The diversionary device trigger mechanism of claim 13, wherein the second trigger mechanism further comprises:

a plunger. wherein the plunger moves along the vertical axis, forcing the bearing and the firing pin to also move along the vertical axis.

* * * * *